US005911172A

United States Patent [19]

Korolenko

[11] Patent Number: 5,911,172

[45] Date of Patent: Jun. 8, 1999

[54] RETRACTABLE UNDERWATER TURRET

[75] Inventor: Kyrill V. Korolenko, East Lyme, Conn.

[73] Assignee: The United States of America as represented by the Secretary of the Navy, Washington, D.C.

[21] Appl. No.: 08/823,776

[22] Filed: Mar. 24, 1997

[51] Int. Cl.[6] ..... F41A 23/24

[52] U.S. Cl. ..... 89/5; 89/38; 114/6; 114/319; 114/320; 114/175

[58] Field of Search ..... 89/5, 38; 114/5, 114/6, 7, 8, 318, 319, 320, 321, 175

[56] References Cited

U.S. PATENT DOCUMENTS

| | | | |
|---|---|---|---|
| Re. 1,631 | 3/1864 | Walker | 114/8 |
| 1,093,504 | 4/1914 | Voller | 114/320 |
| 1,120,247 | 12/1914 | Schneider | 89/38 |
| 1,296,688 | 3/1919 | Noah | 114/6 |
| 3,969,977 | 7/1976 | Opdahl et al. | 89/5 |
| 4,147,124 | 4/1979 | Brooks et al. | 114/321 |
| 5,677,506 | 10/1997 | Wallin | 89/38 |

FOREIGN PATENT DOCUMENTS

| | | | |
|---|---|---|---|
| 114270 | 3/1918 | United Kingdom | 89/5 |

*Primary Examiner*—Stephen M. Johnson
*Attorney, Agent, or Firm*—Michael J. McGowan; Prithvi C. Lall; Robert W. Gauthier

[57] ABSTRACT

The present invention, as disclosed and taught herein, comprises apparatus and method for an underwater turret system suitable for use on surface or underwater vessels. The turret system is housed in an underwater bay from which the turret may be deployed and operated. After operational use the turret system is retracted into the bay whereupon the bay and the system are flushed with rinse water, evacuated and dried by passing drying air through the bay. In a preferred embodiment the turret is fitted with an underwater weapon and operated to attack underwater targets.

20 Claims, 3 Drawing Sheets

RETRACTABLE UNDERWATER TURRET

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a retractable underwater turret system for use on surface or underwater vessels and more specifically to an underwater gun turret and method of operation.

(2) Description of the Prior Art

A search of the prior art disclosed the following U.S. Patents:

U.S. Pat. No. 696,108 issued to H. Maxim on Mar. 11, 1902 discloses a surface vessel having a retractable deck gun turret that in addition to a hydraulic lifting mechanism to raise and lower the turret also employs a column of sea water to assist in raising the gun turret and supporting it in its firing position.

U.S. Pat. No. 1,270,164 issued to J. E. Johannessen et al. on Jun. 18, 1918 discloses a submarine vessel having a retractable deck gun. The deck gun is raised into firing position and retracted by mechanical means and includes a positionable hatch plate which covers the gun chamber when in the retracted position.

U.S. Pat. No. 1,399,395 issued to J. A. Moran on Dec. 6, 1921 discloses a surface vessel having a retractable deck gun that when not in use retracts into a storage chamber immediately below the deck.

U.S. Pat. No. 453,545 issued to J. B. Canet on Jun. 2, 1891 and U.S. Pat. No. 1,296,688 issued to R. S. Noah on Mar. 11, 1919 disclose land based gun installations having retractable turrets.

In all of the above referenced prior art patents the turrets are raised and retracted with the gun barrel in a horizontal position thereby requiring a relatively large opening through which the gun is raised and/or retracted. Further, all of the retractable turret systems disclosed and taught in the above discovered prior art are above the vessel's deck or the earth's surface. None of the prior art discloses or teaches a retractable turret system that is operable underwater.

SUMMARY OF THE INVENTION

The present invention generally relates to a retractable, ship board turret system which is particularly suited for underwater deployment and operation.

Disclosed herein is a method by which a turret system, having an extended gun barrel, may be stored within a shipboard bay and deployed and/or retrieved through an opening of minimum size. As disclosed in further detail below, an elongated turret is longitudinally aligned with the turret's storage bay outer doors whereby the cross sectional profile, of the turret, passing through the storage bay outer doors is minimized.

Further a turret embodying the present invention is suitable for underwater operation from a bay within a vessel which is completely submerged as in a remotely controlled underwater vehicle, submarine, or within a surface vessel's hull below the water line.

Still further a turret as taught herein is particularly suitable for computer controlled target acquisition, aiming and firing.

DESCRIPTION OF THE PREFERRED EMBODIMENT

Figure 2:
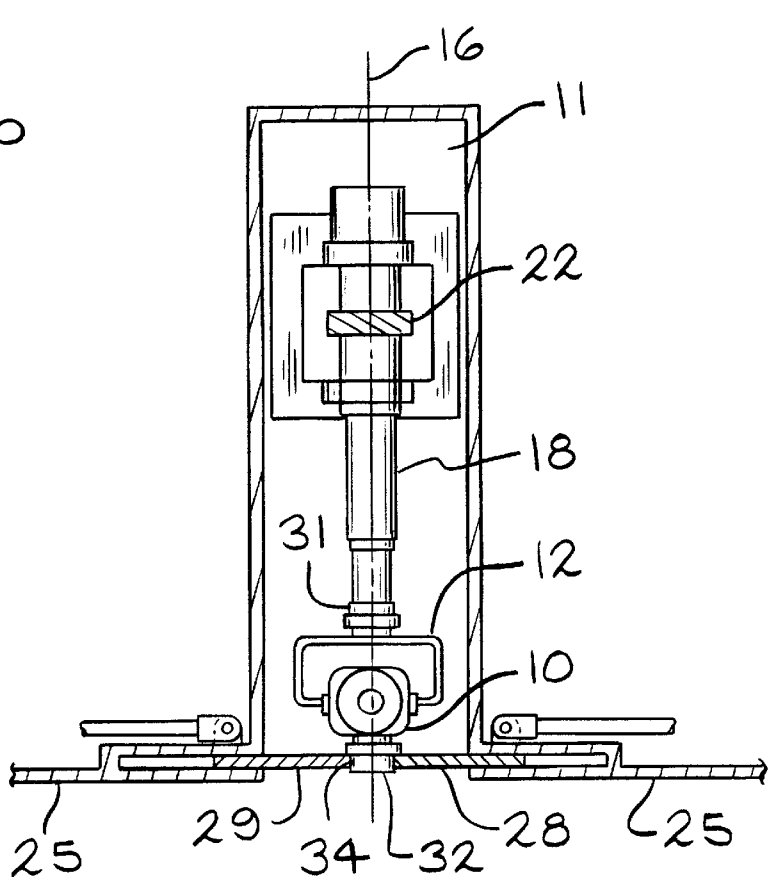
FIG. 2 presents a schematic elevational view taken along line 2—2 in FIG. 1.
Figure 1:
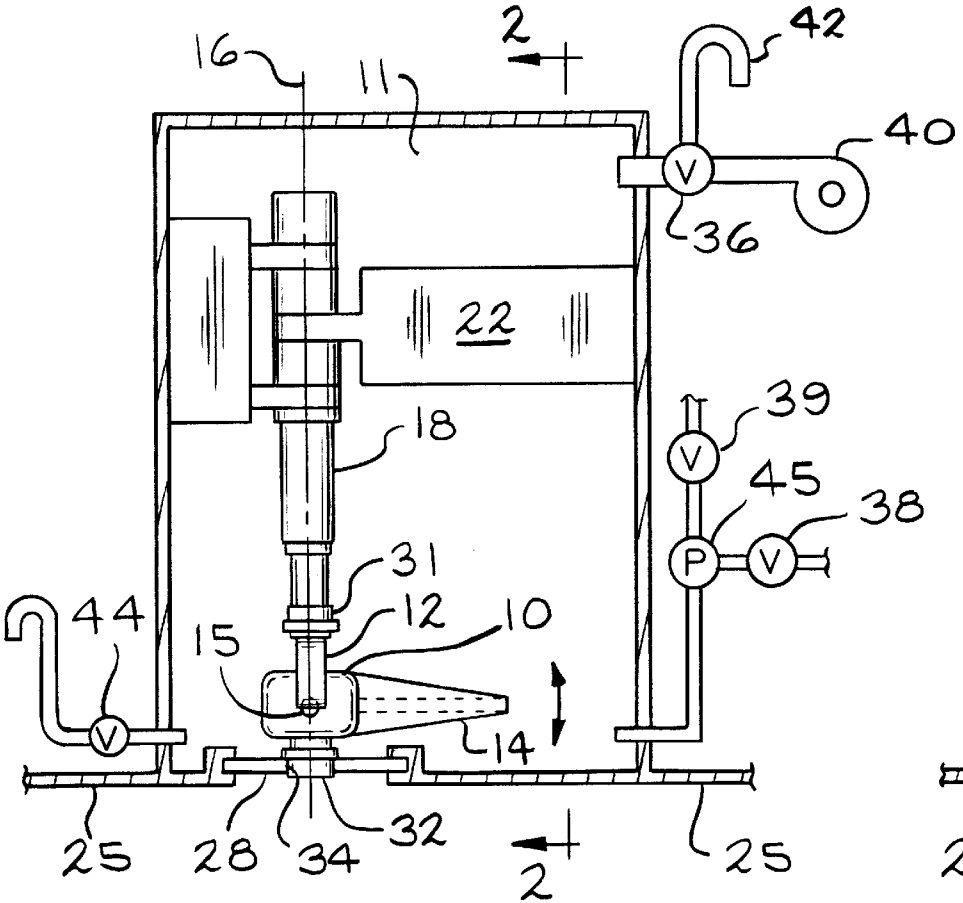
FIG. 1 presents a schematic elevational view of a turret, embodying the present invention for use with an underwater gun, in its stored inactive position within a suitable bay.

Referring now to FIGS. 1, and 2. A retractable, underwater turret 10 is shown in its stored and retracted state within an enclosed, watertight, bay 11. Bay 11 would typically be located within a vessel's hull 25 and below the water line. In the embodiment of FIGS. 1 through 6, turret 10 is shown with underwater gun 14 mounted onto turret 10. Turret 10 is preferably mounted upon gimbal assembly 12 whereby turret 10 may be rotated about pivot 15 and axis 16.

Gimbal assembly 12 is attached to a suitable hydraulic piston assembly 18 which is securely anchored to the vessel's structure by a suitable support structure 22. Water tight, outer doors 28 and 29, are typically closed when turret 10 is in its retracted and stored position as shown in FIGS. 1 and 2. Affixed to one side of turret 10 is plug 32 which acts to plug or otherwise seal circular opening 34 formed by and between doors 28 and 29 when the doors are closed. During storage of turret 10 within bay 11, the bay has no water therein as will be discussed further below.

Figure 3:
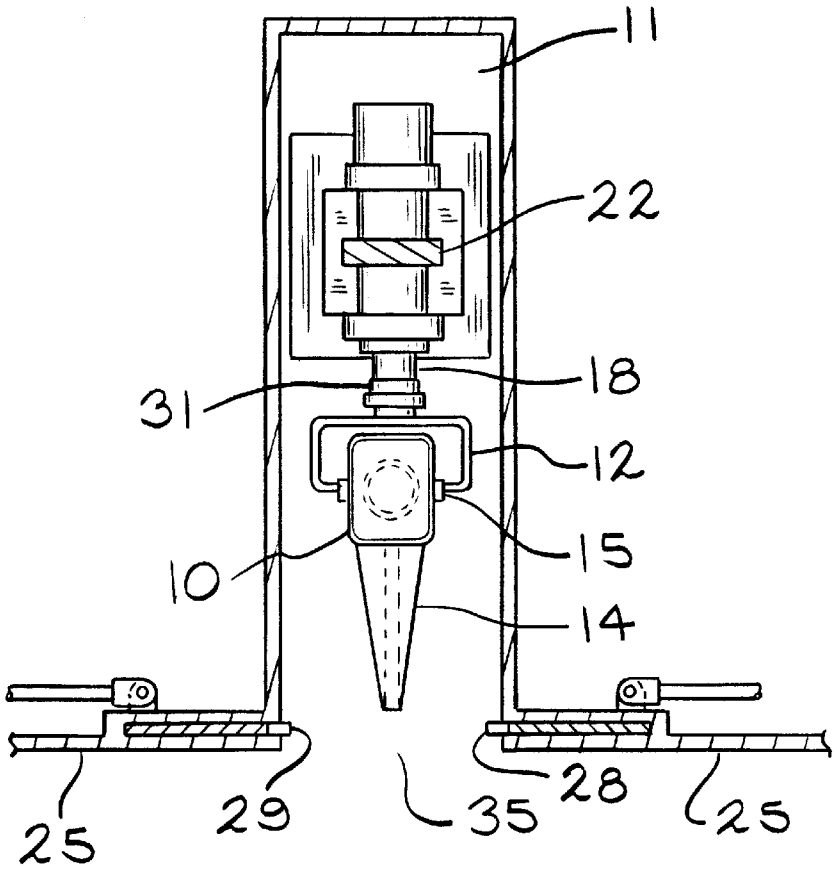
FIG. 3 presents a schematic view, similar to the view as presented in FIG. 2, wherein the turret is in position for deployment through the open outer doors of the bay.

When it is desired to deploy and operate turret 10, bay 11 is first filled with seawater by opening vent 42 via multiport valve 36 and seawater is pumped into bay 11 by means of reversible pump 45 and seawater valve 38. The outer doors 28 and 29 are then opened, thereby releasing plug 32 from circular opening 34. Turret 10 is then retracted to its uppermost position, by hydraulic piston assembly 18, and rotated such that gun 14 is in its vertical deployment position as illustrated in FIG. 3. When doors 28 and 29 are open, an opening 35 is provided whereby turret 10 and gun 14, only in the vertically aligned deployment configuration as illustrated in FIG. 3, may pass therethrough.

Figure 4:
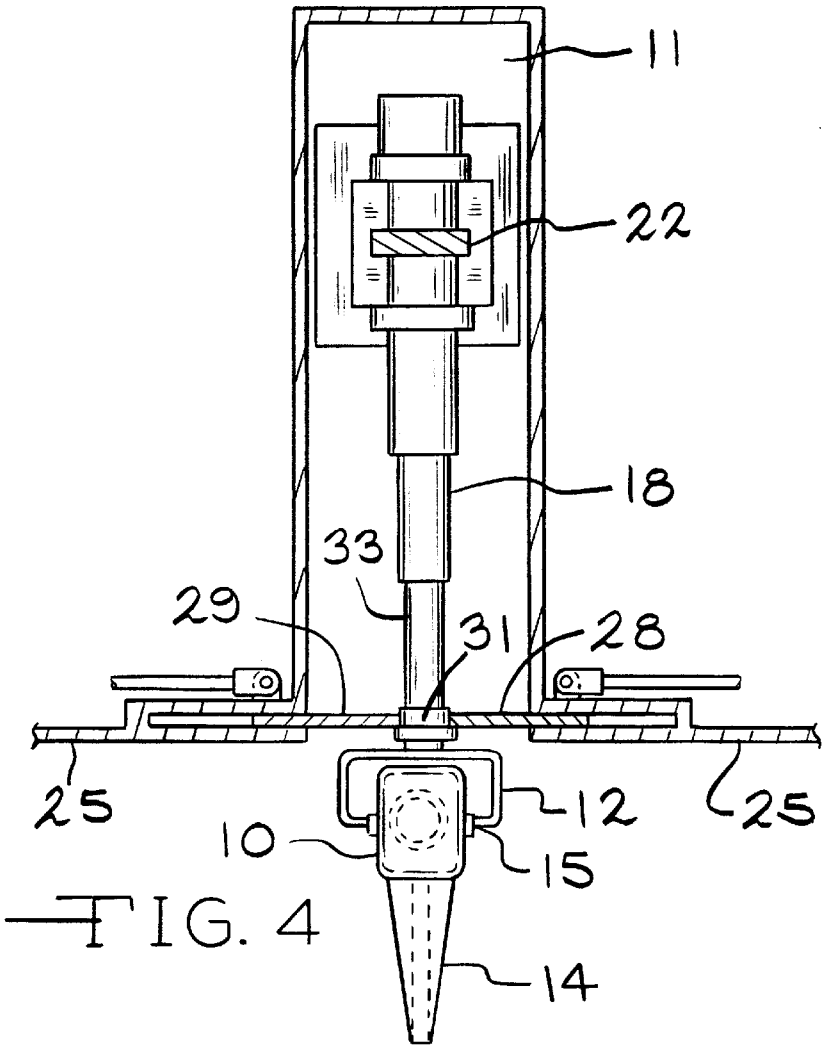
FIG. 4 presents an elevational view, similar to FIGS. 2 and 3, illustrating the turret immediately after exiting the bay and with the outer doors in the closed and operational position.
Figure 6:
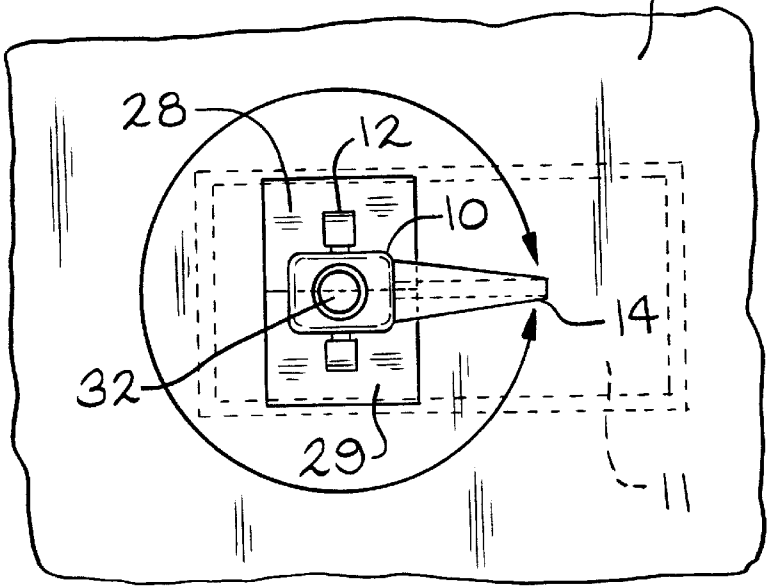
FIG. 6 presents a schematic bottom view of the turret in the fully deployed position as taken along line 6—6 in FIG. 5.
Figure 5:
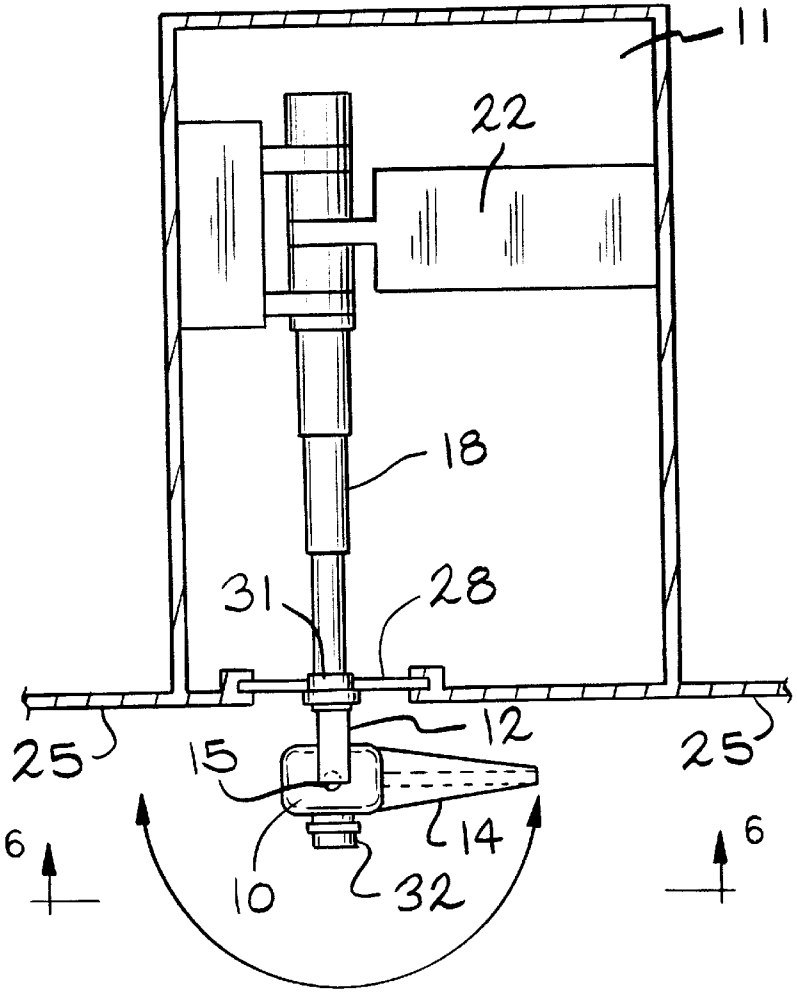
FIG. 5 presents a schematic view, similar to FIG. 1, showing the turret fully deployed and operational.

Upon reaching the vertically extended operational position, as illustrated in FIG. 4, outer doors 28 and 29 are closed with circular opening 34, formed between doors 28 and 29, gripping piston extension 33 about bearing seat 31. Turret 10 and gun 14 are now rotated into the desired position, as illustrated in FIGS. 5 and 6 and gun 14 may be fired by remote control means 50 shown in FIG. 5. The remote control means 50 may provide computer controlled acquisition, aiming and firing as well as remote deployment and operation. When doors 28 and 29 are closed about bearing seat 31, as shown in FIGS. 4 and 5, they also act to structurally support turret 10 thereby assisting in resisting the recoiling effect of gun 14 when the gun 14 is fired.

Recovery of turret 10 within bay 11 is the reverse of the deployment procedure. Turret 10 and gun 14 are moved to the vertically aligned configuration as illustrated in FIG. 4, outer doors 28 and 29 are opened, and turret 10 is retracted, by piston assembly 18, to its upper most position as illustrated in FIG. 3. Once turret 10 and gun 14 are within bay 11, turret 10 is again rotated to its horizontal position and lowered to the bottom of bay 11, as illustrated in FIG. 1, and outer doors 28 and 29 are closed whereby circular opening 34, formed by doors 28 and 29 sealingly closed around plug 32.

Seawater is then pumped out of bay 11 and through valve 38, by reversible pump 45, and fresh rinse water is pumped into bay 11 from fresh water valve 39 whereby turret 10, gun 14 and the inside of bay 11 are rinsed of accumulated salt residue. After the fresh water rinse, the rinse water is pumped out of bay 11 by reversible pump 45 and through valve 38. Dry, heated air is then passed through bay 11, from hot air blower 40 and out through vent valve 44, thereby drying turret 10, gun 14 and bay 11.

The underwater turret 10 as disclosed herein above, may be used on surface or underwater vessels alike.

Although the preferred embodiment as disclosed hereinabove is generally directed to apparatus and method for deploying an underwater weapon system such as an underwater gun the apparatus and method may also be used for the underwater deployment of other devices such as communications equipment, sonar devices, photographic equipment, intelligence gathering devices, or any other desirable attached equipment container 52 as shown in phantom (dotted line) in FIG. 5, and the like.

Although the preferred embodiment as disclosed above is for an underwater turret, the concept may also be adapted for retractable above deck turret installations as well, particularly the method of streamlining the turret, during deployment and retrieval, as illustrated in FIG. 3, whereby the opening through which the turret must pass may be minimized.

It is evident that many alternatives, modifications, and variations of the present invention will be apparent to those skilled in the art in light of the foregoing teachings. Accordingly, the invention is intended to embrace all such alternatives, modifications and variations as may fall within the spirit and scope of the appended claims.

What is claimed is:

1. An underwater turret system comprising:

an underwater turret;

an underwater, water tight bay for storing said turret therein, said bay having door means whereby said turret may be deployed therethrough for operational use;

means for pumping water into and out of said bay;

means for drying said turret and said bay when water has been extracted therefrom; and means for supporting, deploying, and retrieving said turret through said door means.

2. An underwater turret system as claimed in claim 1 wherein said means for deploying and retrieving said turret comprises hydraulic piston means.

3. An underwater turret system as claimed in claim 2 wherein said door means includes means for gripping said piston means when said turret is operationally deployed.

4. The underwater turret system as claimed in claim 3 wherein said door means comprises two opposing, laterally movable doors which are closeable after said turret system is deployed for operational use and wherein said means for gripping said piston means comprises a semicircular opening within each of said opposing doors which when said doors are closed said semicircular openings grippingly surround said piston means thereby providing lateral support for said turret system when in the deployed mode.

5. The under water turret system as claimed in claim 4 wherein said turret system includes plug means around which said semicircular openings of said doors sealingly close when said turret system is in the stored mode and said doors are closed thereby providing the watertight bay.

6. An underwater turret system as claimed in claim 1 wherein said door means includes means for structurally securing said turret when said turret is deployed.

7. An underwater turret system as claimed in claim 1 wherein said turret system further comprises:

an underwater weapon attached to said turret; and remote means for aiming and firing said weapon when said weapon is operationally deployed.

8. An underwater turret system as claimed in claim 7 wherein said remote means for aiming and firing said turret includes computer controlled target acquisition, aiming and firing means.

9. An underwater turret system as claimed in claim 1 wherein said system is integrated into a submarine.

10. An underwater turret system as claimed in claim 1 wherein said system is integrated into a surface ship.

11. An underwater turret system as claimed in claim 1 wherein said turret system further comprises:

underwater equipment attached to said turret; and remote means for operating said equipment when said turret is operationally deployed.

12. In an underwater turret system comprising a turret within a watertight bay wherein said bay includes door means through which said turret may be deployed and means for deploying and recovering said turret wherein said turret includes an attached, extended, equipment container, the method of deploying and retrieving said turret and attached equipment container comprising the steps of:

filling said bay with water;

opening said door means thereby providing an opening through which said turret and attached equipment container may pass;

aligning the centerline of said extended equipment container with the centerline of said door opening;

passing said turret and attached equipment container through said door opening;

closing said door means;

repositioning said extended equipment container to a desired operational position and operating said turret system; and retrieving said turret and attached equipment container into said bay.

13. The method as claimed in claim 12 wherein said step of retrieving said turret and attached equipment container into said bay includes the steps of:

opening said door means thereby providing a door opening through which said turret and attached equipment container may be retrieved;

aligning the centerline of said equipment container with the centerline of said door opening;

retracting said turret and attached equipment container into said bay; and closing said door means.

14. The method as claimed in claim 13 including the additional steps of:

withdrawing the water from within said bay after said door means is closed; and passing drying air through said bay thereby drying said turret and attached equipment container and said bay.

15. The method as claimed in claim 14 wherein, after said water is withdrawn from said bay and before said drying air is passed through said bay, said method further comprises the steps of:

flushing a rinse water solution through said bay thereby rinsing said turret and attached equipment container and said bay; and then extracting said rinse water solution from said bay.

16. An underwater turret system for use on board a vessel having an enclosed, watertight, bay, the bay having at least one wall thereof comprising a portion of said vessel's outer hull surface, the system comprising:

operable, laterally opposed watertight doors within said portion of said vessel's outer hull surface whereby said bay may be opened to the open sea surrounding said vessel;

means for opening and closing said watertight doors;

a turret;

means for supporting said turret within said bay, said means for supporting said turret;

means for conveying an extended portion of said turret through said door opening and positioning said extended portion of said turret outside of said vessel's hull, said extended portion of said turret being laterally supported by an action of said laterally opposed doors being brought to bear against opposed surfaces of said extended portion of said turret; and remote control means for deploying and operating said turret.

17. The turret system as claimed in claim 16 wherein said means for supporting said turret within said bay and conveying said extended portion of said turret through said door opening comprises one or more hydraulic pistons axially aligned with the centroid of said door opening.

18. The turret system as claimed in claim 17 wherein said means for supporting said extended portion of said turret includes gimbal means, between said extended portion of said turret and said hydraulic piston, whereby said extended portion of said turret may be rotated about the axial centerline of said piston and may also be inclined at an angle to said piston axial centerline.

19. The turret system as claimed in claim 16 including means for pumping water into and out of said bay.

20. The turret system as claimed in claim 19 including means for drying said bay and said turret when water has been extracted from said bay.

* * * * *